US006411031B1

(12) United States Patent
Ha et al.

(10) Patent No.: US 6,411,031 B1
(45) Date of Patent: Jun. 25, 2002

(54) DISCHARGE ELECTRODES FOR A COLOR PLASMA DISPLAY PANEL CAPABLE OF LOWERING A DISCHARGE VOLTAGE

(75) Inventors: Hong-Ju Ha; Hun-Gun Park, both of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/228,271

(22) Filed: Jan. 11, 1999

(30) Foreign Application Priority Data

Jan. 12, 1998 (KR) ..... 98-610

(51) Int. Cl.[7] ..... H01J 17/49
(52) U.S. Cl. ..... 313/582; 313/586; 313/587
(58) Field of Search ..... 313/582, 583, 313/584, 585, 586, 587, 479, 495, 496, 497

(56) References Cited

U.S. PATENT DOCUMENTS 3,801,851 A * 4/1974 Andoh et al. ..... 313/586
3,993,921 A * 11/1976 Robinson ..... 313/586
5,900,694 A * 5/1999 Matsuzaki et al. ..... 313/582
6,097,149 A * 8/2000 Miyaji et al. ..... 313/582

FOREIGN PATENT DOCUMENTS

| | | |
|---|---|---|
| JP | 05266800 A | 10/1993 |
| JP | 09330664 | 12/1997 |
| JP | 11126561 | 5/1999 |
| JP | 2000149772 | 5/2000 |

* cited by examiner

*Primary Examiner*—Nimeshkumar D. Patel
*Assistant Examiner*—Mariceli Santiago
(74) *Attorney, Agent, or Firm*—Fleshner & Kim, LLP

(57) ABSTRACT

Discharge electrodes for a color plasma display panel forming a discharge pair on one of two substrates coupled to each other spaced a given distance away from one another, including a transparent electrode positioned in the middle of a discharging cell; and opaque electrodes each spaced a given distance away from both sides of the transparent electrode and insulated by a dielectric layer. The opaque electrodes are made of metal. The transparent electrode is formed in parallel to the opaque electrodes.

29 Claims, 4 Drawing Sheets

DISCHARGE ELECTRODES FOR A COLOR PLASMA DISPLAY PANEL CAPABLE OF LOWERING A DISCHARGE VOLTAGE

BACKGROUND OF THE INVENTION

1. Field of the Invention

The present invention relates to a plasma display panel (PDP), a kind of light emitting device which displays image information by the use of a gas discharge, and more particularly to a plasma display panel (PDP) that has improved discharge sustaining electrodes pairing up and mutually discharging to maintain light emission of cells for a given period of time, thereby enhancing the discharge efficiency and luminance.

2. Discussion of Related Art

A color PDP is a light emitting device that displays image information by using a gas discharge produced therein, and there is no need to provide an active device to each cell, thus simplifying the manufacturing process, easily increasing the size of a screen, and assuring a high response speed. Therefore, it is used for a display device with a large screen, particularly, a wall-mounted television, a high definition television, indoor/outdoor ad display devices.

In addition, since the PDP can be easily manufactured in larger size than a conventional liquid crystal display, it is suitable for large-sized display devices of more than 40 inches. According to its schematic structure, two glass substrates are coupled to each other by a frit glass, and a very small space between the two glasses is sealed. The sealed space is filled with a gas at 100 to 600 Torr, and a penning gas containing He and Xe is commonly used.

In the display each intersection of plural electrodes defines a single cell. A voltage of more than 100V is applied to intersecting electrodes at the time of driving, and the single cell can be energized to produce a gas discharge forming one element of dot-matrix display.

The PDP is characterized as two-electrode, three-electrode, four-electrode types according to the number of electrodes assigned to each cell. The two-electrode PDP has two electrodes, and voltages for addressing and for sustaining are applied together. The three-electrode PDP is called 'sheet discharge PDP', and is switched or maintained by the voltage applied to electrodes positioned on the side of the discharging cell.

Referring to FIGS. 1 to 3, a device will be described by way of an example.

FIG. 1 depicts upper and lower substrates of a PDP, and an upper substrate 1 of a display panel and a lower substrate 2 are coupled to each other in parallel with a given interval. A common electrode C and a scan electrode S are paired as discharge sustaining electrodes for maintaining light emission of cells in one pixel on upper substrate 1, and a dielectric layer 5 that limits discharge current of the two electrodes and provides insulation between the electrode pair is formed on upper substrate 1. A protective layer 6 is formed on dielectric layer 5. Lower substrate 2 includes barrier ribs 3 forming plural discharging spaces, i.e. cells; a plurality of address electrodes A formed in parallel with barrier ribs 3 and carrying out address discharge at each intersection of scan electrode S and them to produce vacuum ultraviolet rays; fluorescent layers 4 formed on both barrier ribs 3 and lower substrate 2, thus emitting a visible ray during address discharging.

The discharge sustaining electrodes that are paired each have a width of 300 $\mu$m, as shown in FIG. 2, and include ITO electrodes 7 and BUS electrodes 8. ITO electrode 7 is formed of a transparent material, and once voltage is applied to both ends, mutual sheet discharge occurs within the corresponding discharging cell. BUS electrodes 8, formed of a metal, each have a width of 50 to 100 $\mu$m, and are respectively deposited on ITO electrodes 7 to prevent voltage drop due to the resistance of ITO electrodes.

FIG. 2 is a sectional view of a cell while the upper and lower substrates are coupled to each other, and FIGS. 3*a* and 3*b* depict conventional discharge sustaining electrodes.

The process of displaying the image information according to the conventional PDP is as follows. When a voltage for starting discharge is applied between scan electrode S and common electrode C, sheet discharge occurs between two electrodes to produce wall electric charge within the corresponding discharging cell. After that, as an address discharge voltage is applied to scan electrode S and corresponding address electrode A, a writing discharge occurs within the cell. If the discharge sustaining voltage is applied across the corresponding scan electrode S and common electrode c, sustaining discharge occurs by electric particles produced at the time of address discharging between address electrode A and scan electrode S so that the light emission of cells is maintained for a given period of time.

An electric field is generated within the corresponding cell by discharge between the electrodes to accelerate a small amount of electrons among the discharge gas, and the accelerated electrons are collided with neutral particles of the gas to be ionized to electrons and ions. The ionized electrons are collided with neutral particles again, so the neutral particles are ionized to electrons and ions at high speed, thus producing vacuum ultraviolet rays, simultaneously with converting the discharge gas into a plasma. The produced ultraviolet rays exitate fluorescent layers 4 to generate visible rays, and as the visible rays are jetted out through upper substrate 1, the light emission of the corresponding cell can be recognized from the outside.

The discharge capacitance of ITO electrode 7 to which the discharge voltage is applied exerts a great influence upon the discharge. Referring to FIG. 3*a,* a distance between the electrodes is decreased by ITO electrodes 7 to lower the discharge voltage. However, this structure may increase the capacitance.

FIG. 3*b* depicts another conventional structure of discharge sustaining electrode with BUS electrode 8' only without using the ITO electrode, and in this case, a distance d' between the electrodes is increased to lower the capacitance, which makes the discharge voltage high to produce a discharge. In addition, if distance d' between the electrodes is decreased, the switching rate may be lowered by BUS electrodes 8'.

SUMMARY OF THE INVENTION

Accordingly, the present invention is directed to discharge electrodes for a color plasma display panel (PDP) that substantially obviates one or more of the problems due to limitations and disadvantages of the related art.

An object of the present invention is to provide discharge electrodes for a color plasma display panel which is capable of lowering a discharge voltage with an increased distance between discharge sustaining electrodes, thus lowering the power consumption of a PDP and enhancing the discharge efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention discloses discharge electrodes for a color plasma display panel forming a discharge pair on one of two substrates coupled to each other spaced a given distance away from one another, including a transparent electrode positioned in the middle of a discharging cell; and opaque electrodes each spaced a given distance away from both sides of the transparent electrode and insulated by a dielectric layer. The opaque electrodes are made of metal. The transparent electrode is formed in parallel to the opaque electrodes. An external power supply is not applied to the transparent electrode. The transparent electrode is positioned with a different height from that of the respective opaque electrodes in the dielectric layer. The transparent electrode is positioned nearer a discharging space than the opaque electrodes.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

Figure 1:
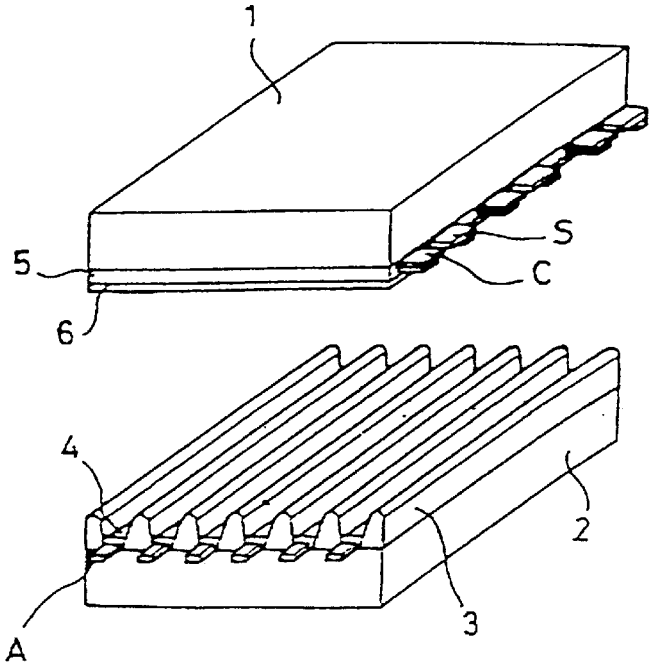
FIG. 1 (Related Art)
FIG. 1 is a perspective view of conventional PDP's upper and lower substrates separated from each other.
Figure 2:
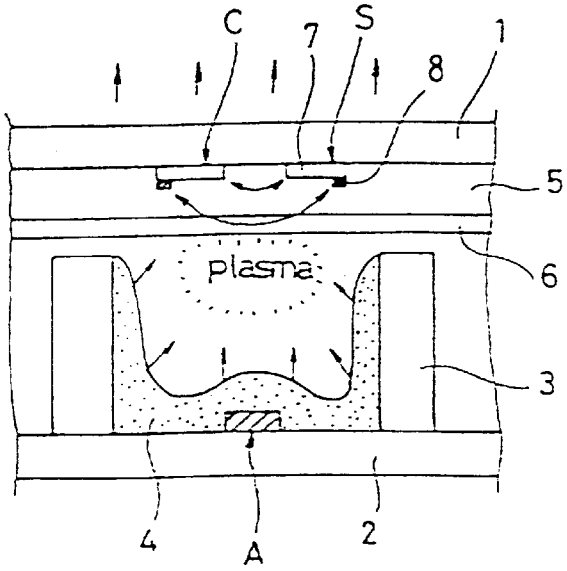
FIG. 2 (Related Art)
FIG. 2 is an enlarged sectional view of a discharge electrode of the conventional PDP.
Figure 3A:
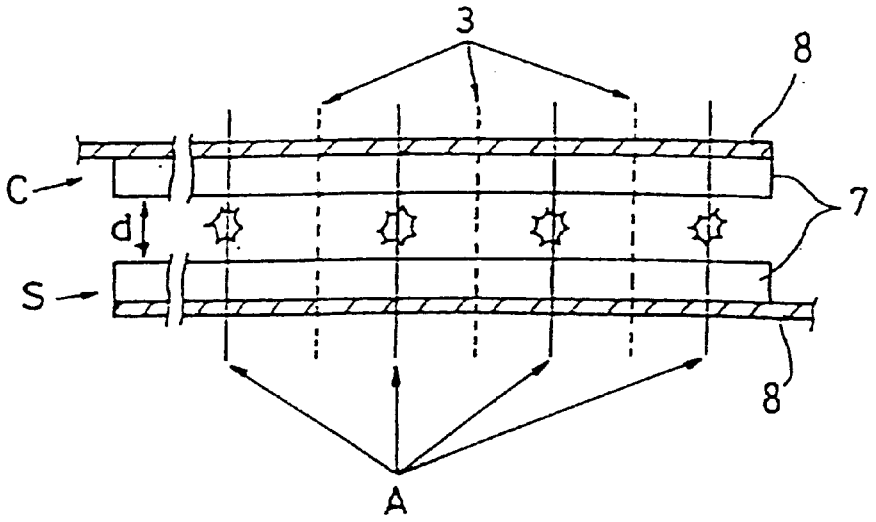
FIG. 3a (Related Art)
Figure 3B:
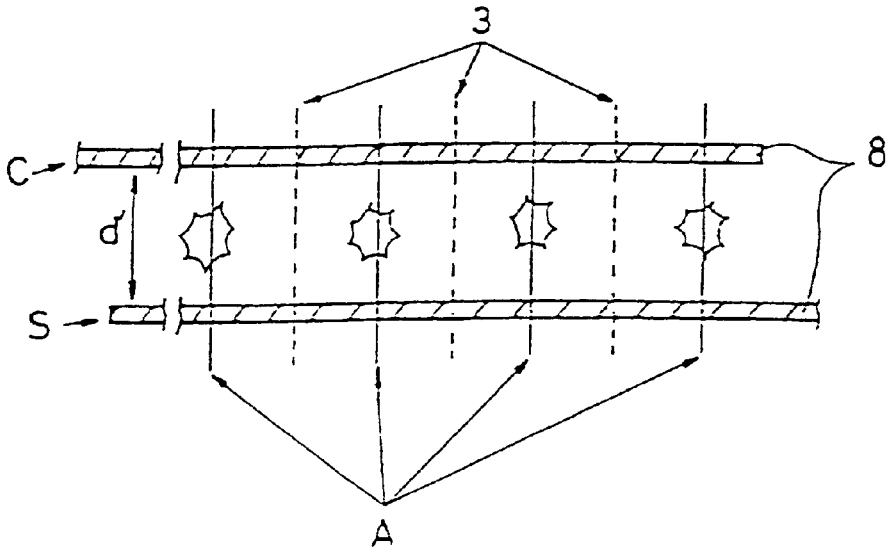
FIG. 3b (Related Art)
Figure 4:
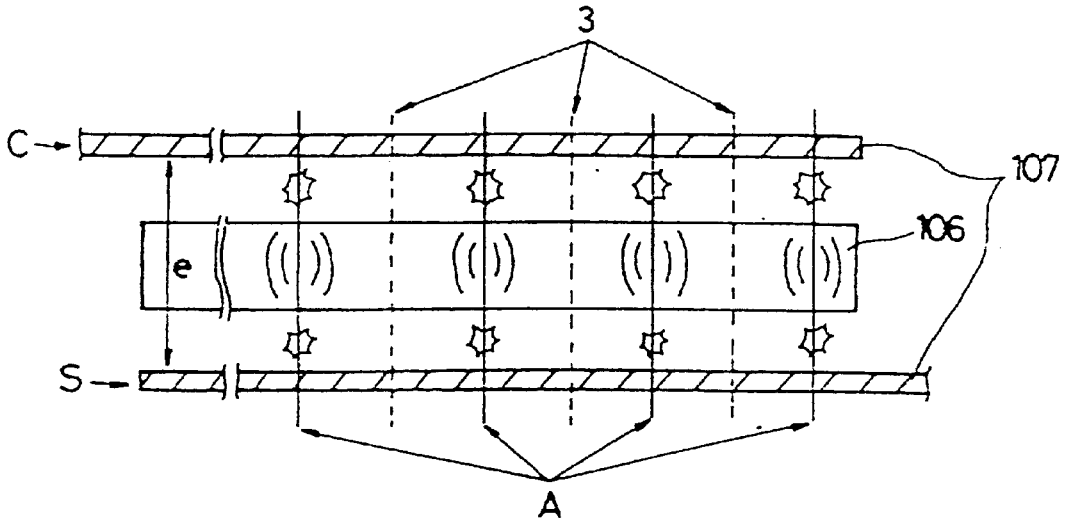
Figure 5:
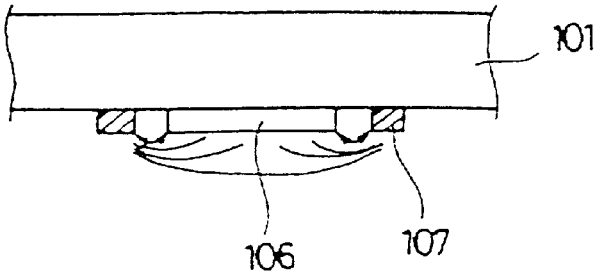
Figure 6A:
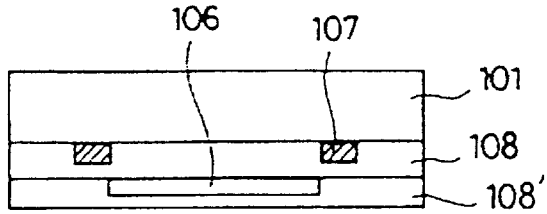
Figure 6B:
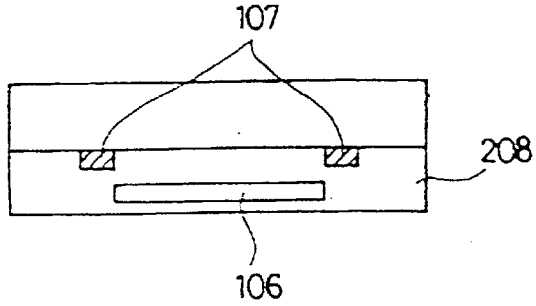
Figure 6C:
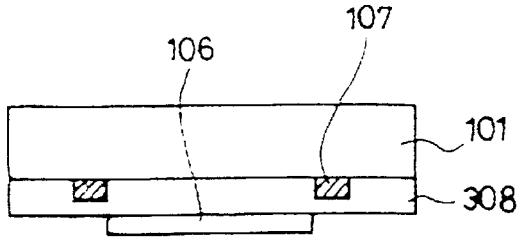

FIG. 3*a* depicts discharge electrodes in accordance with a preferred embodiment of the conventional art;

FIG. 3*b* depicts discharge electrodes in accordance with another preferred embodiment of the conventional art;

FIG. 4 depicts discharge electrodes for a PDP in accordance with the present invention;

FIG. 5 is a sectional view of discharge sustaining electrodes for a PDP in accordance with a first preferred embodiment of the present invention; and FIGS. 6*a* to 6*c* are sectional views of discharge sustaining electrodes for a PDP in accordance with another preferred embodiment of the present invention.

DETAILED DESCRIPTION OF PREFERRED EMBODIMENT

Reference will now be made in detail to the preferred embodiments of the present invention, examples of which are illustrated in the accompanying drawings.

The inventive discharge sustaining electrode structure includes an ITO electrode 106 of transparent material and metallic BUS electrodes 107 having a common electrode C and a scan electrode S in pairs and spaced a given distance away from ITO electrode 106.

Once a discharge sustaining voltage is applied to BUS electrodes 107, a discharge starts with BUS electrodes 107 at both sides of ITO electrode 106, as shown in FIG. 4, so light emission of cells is maintained for a given period of time and discharge is gradually spread to increase the discharge. BUS electrodes 107 are spaced a relatively large distance away from one another, and the switching rate of the discharging space is increased to enhance the luminance.

ITO electrode 106 does not directly contact BUS electrodes 107 in which a discharge is produced, and becomes a virtual electrode to which an external voltage is not applied. That is, ITO electrode 106 serves as a medium transferring the discharge between BUS electrodes 107. When BUS electrodes 107 start to discharge, the distance of discharge is decreased by the width of ITO electrode 106, thus reducing the capacitance between the electrodes and the discharge voltage.

In conclusion, ITO electrode 106 spreads the plasma and makes it easy to form the plasma after starting the discharge, thus increasing the luminance and discharge efficiency.

FIG. 5 is a sectional view of discharge sustaining electrode in accordance with the above preferred embodiment of the present invention.

FIGS. 6*a* to 6*c* depict another preferred embodiment of the present invention, and show ITO electrode 106 and BUS electrodes 107 with different height.

Referring to FIG. 6*a*, a first dielectric layer 108 and a second dielectric layer 108' are formed on a substrate 101, and ITO electrode 106 is formed in second dielectric layer 108'. BUS electrodes 107 are formed in first dielectric layer 108.

Referring to FIG. 6*b*, an ITO electrode 106 is formed in a dielectric layer 208 nearer a discharging space than BUS electrodes 107, and FIG. 6*c* depicts an ITO electrode 106 formed on dielectric layer 308.

According to the above preferred embodiment of the present invention, ITO electrode 106 that serves as a path of an electric field created between BUS electrodes 107 and assists discharging, is formed near the discharging space, thus facilitating the flow of the outside electric field between ITO electrodes 107 that play an important role in formation of plasma by actual discharge, and enhancing the discharge efficiency.

In the conventional discharge sustaining electrode structure, the voltage for starting discharge and capacitance cannot be simultaneously reduced due to the relationship of the interval between the electrodes and the capacitance, and according to the present invention, the capacitance and the voltage for starting discharge can be simultaneously decreased without effect on the switching rate and the interval between the electrodes.

According to the present invention, the discharge path is increased to enhance the luminance, and the capacitance is decreased to improve the discharge efficiency.

It will be apparent to those skilled in the art that various modifications and variations can be made in the discharge electrodes for a color plasma display panel of the present invention without departing from the spirit or scope of the invention. Thus, it is intended that the present invention cover the modifications and variations of this invention provided they come within the scope of the appended claims and their equivalents.

What is claimed is:

1. Discharge electrodes for a color plasma display panel, comprising:

a transparent ITO electrode which is configured as one of a continuum of transparent ITO electrodes positioned in the middle of a series of cells of a line; and opaque electrodes each spaced a given distance away from both sides of the transparent ITO electrode so that the transparent ITO electrode does not directly contact the opaque electrodes, wherein the opaque electrodes are insulated by a dielectric layer, wherein the width of the transparent ITO electrode is wider than each of the opaque electrodes, and wherein an external power supply is not applied to the transparent ITO electrode.

2. Discharge electrodes according to claim 1, wherein the opaque electrodes are made of metal.

3. Discharge electrodes according to claim 1, wherein the transparent ITO electrode is formed in parallel to the opaque electrodes.

4. Discharge electrodes according to claim 1, wherein the transparent ITO electrode is positioned with a different height from that of the respective opaque electrodes in the dielectric layer.

5. Discharge electrodes according to claim 1, wherein the transparent ITO electrode is positioned nearer a discharging space than the opaque electrodes.

6. Discharge electrodes according to claim 1, wherein the transparent ITO electrode serves as a medium for transferring discharge between the opaque electrodes.

7. Discharge electrodes according to claim 1, wherein the transparent ITO electrode is at least twice as wide as each of the opaque electrodes.

8. Discharge electrodes according to claim 1, wherein the transparent ITO electrode is at least three times as wide as each of the opaque electrodes.

9. Discharge electrodes according to claim 1, wherein the transparent ITO electrode does not overlap any portion of the opaque electrodes.

10. Discharge electrodes according to claim 1, wherein the opaque electrodes are coplanar with each other and not coplanar with the transparent ITO electrode.

11. A discharge sustaining electrode structure for a color plasma display panel, comprising:

a transparent ITO electrode, wherein an external power supply is not applied to the transparent ITO electrode; and opaque bus electrodes, wherein each opaque bus electrode is spaced a given distance away from the transparent ITO electrode, centering the transparent ITO electrode between the opaque bus electrodes, wherein the opaque bus electrodes are insulated by a dielectric layer.

12. Discharge electrodes according to claim 11, wherein the opaque bus electrodes are made of metal.

13. Discharge electrodes according to claim 11, wherein the transparent ITO electrode is formed in parallel to the opaque bus electrodes.

14. Discharge electrodes according to claim 11, wherein the transparent electrode is positioned with a different height from that of the respective opaque bus electrodes in the dielectric layer.

15. Discharge electrodes according to claim 11, wherein the transparent electrode is positioned nearer a discharging space than the opaque bus electrodes.

16. Discharge electrodes according to claim 11, wherein the transparent ITO electrode is at least twice as wide as each of the opaque electrodes.

17. Discharge electrodes according to claim 11, wherein the transparent ITO electrode is at least three times as wide as each of the opaque electrodes.

18. Discharge electrodes according to claim 11, wherein the transparent ITO electrode does not overlap any portion of the opaque electrodes.

19. Discharge electrodes according to claim 11, wherein the opaque electrodes are coplanar with each other and not coplanar with the transparent ITO electrode.

20. A plasma display panel, comprising:

an upper substrate;

a lower substrate, which is coupled to the upper substrate;

a dielectric layer; and a discharge sustaining electrode structure, comprising:

an ITO electrode, and bus electrodes, wherein each bus electrode is spaced a given distance away from the sides of the ITO electrode and each bus electrode does not overlap the ITO electrodes, centering the ITO electrode between the bus electrodes, wherein the bus electrodes are insulated by the dielectric layer and wherein the ITO electrode is at least twice as wide as each bus electrode, and wherein an external power supply is not applied to the ITO electrode.

21. The plasma display panel of claim 20, wherein the ITO electrode is transparent.

22. The plasma display panel of claim 20, wherein the bus electrodes are metallic and opaque.

23. The plasma display panel of claim 20, wherein the ITO electrode is formed in parallel to the bus electrodes.

24. The plasma display panel of claim 20, wherein the bus electrodes are not connected to each other and the ITO electrode is only in contact with the upper substrate and the dielectric layer.

25. The plasma display panel of claim 20, wherein the ITO electrode is positioned with a different height from that of the bus electrodes in the dielectric layer.

26. The plasma display panel of claim 20, wherein the ITO electrode is positioned nearer a discharging space than the bus electrodes.

27. Discharge electrodes according to claim 20, wherein the transparent ITO electrode is at least three times as wide as each of the opaque electrodes.

28. Discharge electrodes according to claim 20, wherein the opaque electrodes are coplanar with each other and not coplanar with the transparent ITO electrode.

29. Discharge electrodes according to claim 20, wherein the ITO electrode is transparent and an external power supply is not applied to the ITO electrode.

* * * * *